US007124731B2

(12) United States Patent
Eguchi et al.

(10) Patent No.: US 7,124,731 B2
(45) Date of Patent: Oct. 24, 2006

(54) INTERNAL COMBUSTION ENGINE WITH OIL TEMPERATURE SENSOR

(75) Inventors: Masataka Eguchi, Wako (JP); Satoru Narita, Wako (JP); Masaya Adachi, Wako (JP); Masanobu Urabe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/918,730

(22) Filed: Aug. 13, 2004

(65) Prior Publication Data

US 2005/0092283 A1 May 5, 2005

(30) Foreign Application Priority Data

Sep. 19, 2003 (JP) ..... 2003-327624
Sep. 19, 2003 (JP) ..... 2003-327625

(51) Int. Cl.
*F01N 7/10* (2006.01)

(52) U.S. Cl. ..... 123/196 M; 60/323

(58) Field of Classification Search ..... 123/196 R, 123/196 M, 196 AB, 196 CP, 196 A, 90.33, 123/90.34; 184/6.5, 6.9
See application file for complete search history.

(56) References Cited

U.S. PATENT DOCUMENTS 5,215,061 A * 6/1993 Ogawa et al. ..... 123/478
5,588,406 A * 12/1996 Ito et al. ..... 123/90.34
5,823,159 A * 10/1998 Ariga ..... 123/196 AB
6,632,144 B1 * 10/2003 Narita et al. ..... 464/179

FOREIGN PATENT DOCUMENTS

JP 2000-213326 8/2000
JP 2001-193432 7/2001

* cited by examiner

*Primary Examiner*—Stephen K. Cronin
*Assistant Examiner*—Hyder Ali
(74) *Attorney, Agent, or Firm*—Hamre, Schumann, Mueller & Larson, PC

(57) ABSTRACT

The invention relates to an engine arrangement that increases the degree of freedom of the engine state sensor while decreasing the size of the engine body. More specifically, the engine is formed with a chamber for housing a valve train and serving dually as a return oil path of the lubricating oil after having lubricated the valve train. The engine includes an oil temperature sensor partially exposed on one side of a cylinder block and an exhaust pipe partially exposed on the opposite side of the cylinder block.

7 Claims, 6 Drawing Sheets

INTERNAL COMBUSTION ENGINE WITH OIL TEMPERATURE SENSOR

CROSS REFERENCE TO RELATED APPLICATIONS

This application is based on Japanese patent application nos. 2003-327624 and 2003-327625.

FIELD OF THE INVENTION

The present invention relates to an internal combustion engine with a sensor for detecting the running state of the engine.

BACKGROUND OF THE INVENTION

Oil temperature sensors for detecting temperature of lubricating oil in an internal combustion engine are conventionally used to detect temperature of lubricating oil within a lubricating oil passage or within an oil pan. For example, in an internal combustion engine disclosed in Japanese Patent No. 2000-213326, an oil return passage for returning the oil which has lubricated a valve train is formed by penetrating a cylinder block. An intermediate portion of the oil return passage bulges downward forming an oil reservoir and a detection unit of a temperature sensor which has been threadedly inserted from a side wall of the cylinder block faces the oil reservoir.

In the above-described system, a timing chain chamber, which is a housing chamber for housing a timing chain for driving a camshaft of a valve train, is formed by penetrating the cylinder block in parallel with the oil return passage. For this reason, there is a drawback that the cylinder block becomes large-sized by a portion corresponding to the oil return passage to be formed, and further the temperature sensor is to be arranged so as to avoid the timing chain chamber having comparatively large width in the circumferential direction with the cylinder axis as the center while excluding interference with and influence of peripheral members to be arranged around the cylinder block such as exhaust pipes. Therefore, layout of the temperature sensor has possibly been restricted.

SUMMARY OF THE INVENTION

An object of the invention is to increase the degree of freedom of the layout of the oil temperature sensor while minimizing the size of the engine body. Another object of the invention is to further improve detection precision of engine temperature via measuring the temperature of the lubricating oil. It is also an object of the invention to improve or maintain lubricity of component elements of the valve system to be housed in the housing chamber through the use of the lubricating oil in the oil reservoir.

According to the invention, there is provided an internal combustion engine having: an engine body formed with combustion space; a valve system including a valve train for opening/closing an intake valve and an exhaust valve; and an oil temperature sensor for detecting temperature of lubricating oil, characterized in that the engine body is formed with a housing chamber for housing component elements of the valve system; the housing chamber serves dually as a return oil path of the lubricating oil after having lubricated the valve train; and the oil temperature sensor has been installed to the engine body in order to detect temperature of the lubricating oil within the housing chamber.

According to the invention, since the oil temperature sensor detects temperature of lubricating oil within a housing chamber serving dually as the return oil path, it is not necessary to provide the engine body with a return oil path capable of temperature measurement due to the oil temperature sensor separately from the housing chamber, but there is no need for installing any oil temperature sensor by avoiding the housing chamber. Therefore, layout of the oil temperature sensor is not restricted by the housing chamber.

In addition, the housing chamber is provided with an oil reservoir for storing the lubricating oil which flows along the inner wall surface of the chamber wall; the bottom wall of the oil reservoir is formed with a drain passage far causing one portion of the lubricating oil stored to flow out from the oil reservoir at all times; and the oil temperature sensor is used to detect temperature of the lubricating oil stored in the oil reservoir.

Since the oil temperature sensor detects temperature of the lubricating oil stored in the oil reservoir, it becomes possible to detect the engine temperature accurately, and since the lubricating oil within the oil reservoir flows out from the drain passage at the bottom wall at all times, old lubricating oil does not stagnate, but is smoothly replaced with newly-flowed-in lubricating oil within the oil reservoir. Therefore, temperature of the lubricating oil obtained by reflecting engine temperature closer to the newest engine driving state can be detected by the oil temperature sensor.

In addition the above-described component elements are driving force transmission members of the valve system, and the oil reservoir is provided with an outflow passage for supplying the lubricating oil which overflows from the oil reservoir to the driving force transmission members. Since the lubricating oil which overflows from the oil reservoir is used to lubricate the driving force transmission members, the driving force transmission members can be reliably lubricated.

Further, the engine body has a cylinder head provided with the intake valve and the exhaust valve; the valve train has an intake rod and an exhaust rod for transmitting a valve-opening driving force of a valve train cam provided on the camshaft to the intake valve and the exhaust valve; and the oil reservoir is provided with through-holes through which the intake rod and the exhaust rod, which are the driving force transmission members are inserted.

In some embodiments, a rod chamber for housing the intake rod and the exhaust rod of the OHV type valve train equipped with the intake rod and the exhaust rod serves dually as a return path of lubricating oil. Moreover, the outflow passage can be constructed by the through-holes.

According to the invention, since the outflow passage is constructed by the through-hole through which each rod is inserted, it is not necessary to form any outflow passage for the lubricating oil which overflows from the oil reservoir separately from the through-hole.

Since it is not necessary to provide the engine body with a return oil path capable of installing the oil temperature sensor separately from the housing chamber, the engine body is restrained from becoming large-sized and yet layout of the oil temperature sensor is not restricted by the housing chamber as compared with an engine body in which the return oil path for detecting temperature of lubricating oil and the housing chamber for housing component elements of the valve system are provided separately. Therefore, the degree of freedom of the oil temperature sensor in layout becomes larger.

In addition, since temperature of the lubricating oil obtained by reflecting engine temperature close to the newest engine driving state can be detected by the oil temperature sensor, detection precision of the engine temperature through temperature of the lubricating oil is improved. Also, since the driving force transmission members can be lubricated through the use of the oil reservoir for detecting temperature of the lubricating oil, the lubricity of the driving force transmission members to be housed in the housing chamber can be improved or maintained. Moreover, since the rod chamber serves dually as the return path of lubricating oil, the engine body is restrained from becoming large-sized even in this respect. Because it is not necessary to form any outflow passage separately from the through-hole, it is possible to enlarge the capacity of the oil reservoir, and to contribute to improved detection precision of temperature of the lubricating oil even in this point.

According to some embodiments, there is further provided an internal combustion engine having: an engine body in which combustion space has been formed; an exhaust pipe provided in the engine body in order to discharge exhaust gas from the combustion space; and a driving state sensor installed partially exposed to the outside portion of the engine body in order to detect the engine driving state, characterized in that the exhaust pipe is arranged facing the other side portion of the engine body different from one side portion of the engine body in which the exposure portion of the driving state sensor is arranged, and the exposure portion is located at a position whereat radiant heat from the exhaust pipe is shielded by the engine body.

According to the above-described embodiment of the invention, there is no possibility that on the exposure portion of the driving state sensor installed to the engine body, radiant heat from the exhaust pipe directly strikes by the engine body. The radiant heat from the portion facing the engine body, which is particularly a portion of the exhaust pipe to be arranged comparatively close to the driving state sensor, is shielded by the engine body itself without providing the engine body with ribs and the bracket, and yet without the need for arranging the exhaust pipe far apart from the exposure portion because the portion which those face is arranged facing the other side portion of the engine body different from one side portion in which the exposure portion is arranged. As such, the oil temperature sensor is capable of detecting accurate temperature with the influence of thermal radiation from the exhaust pipe reduced.

DETAILED DESCRIPTION OF THE INVENTION

Hereinafter, with reference to FIGS. 1 to 7, the description will be made of an embodiment of the present invention.

Figure 1:
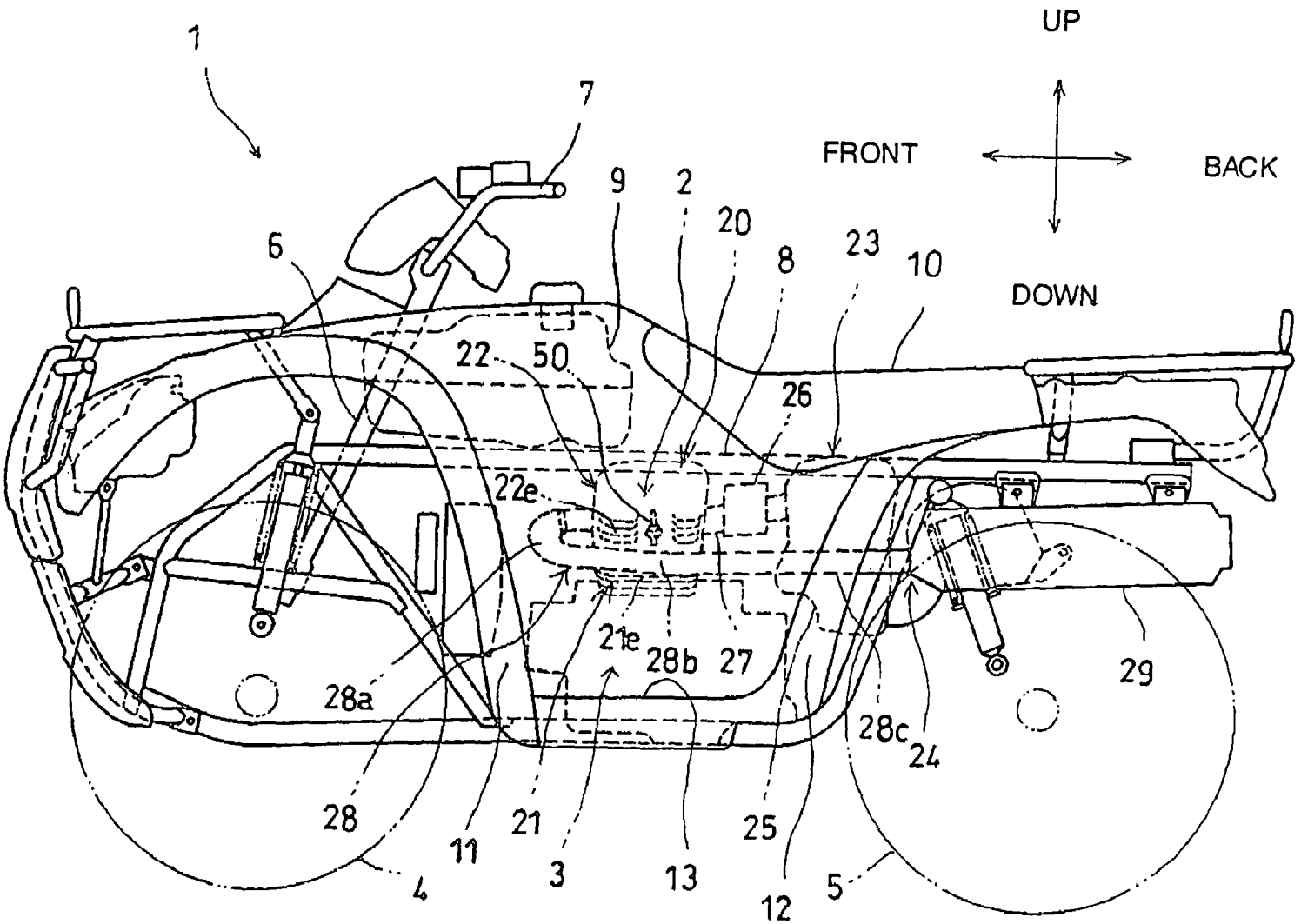
FIG. 1 is a schematic left side view showing a vehicle with an internal combustion engine to which the present invention has been applied, mounted, showing an embodiment according to the present invention.
Figure 2:
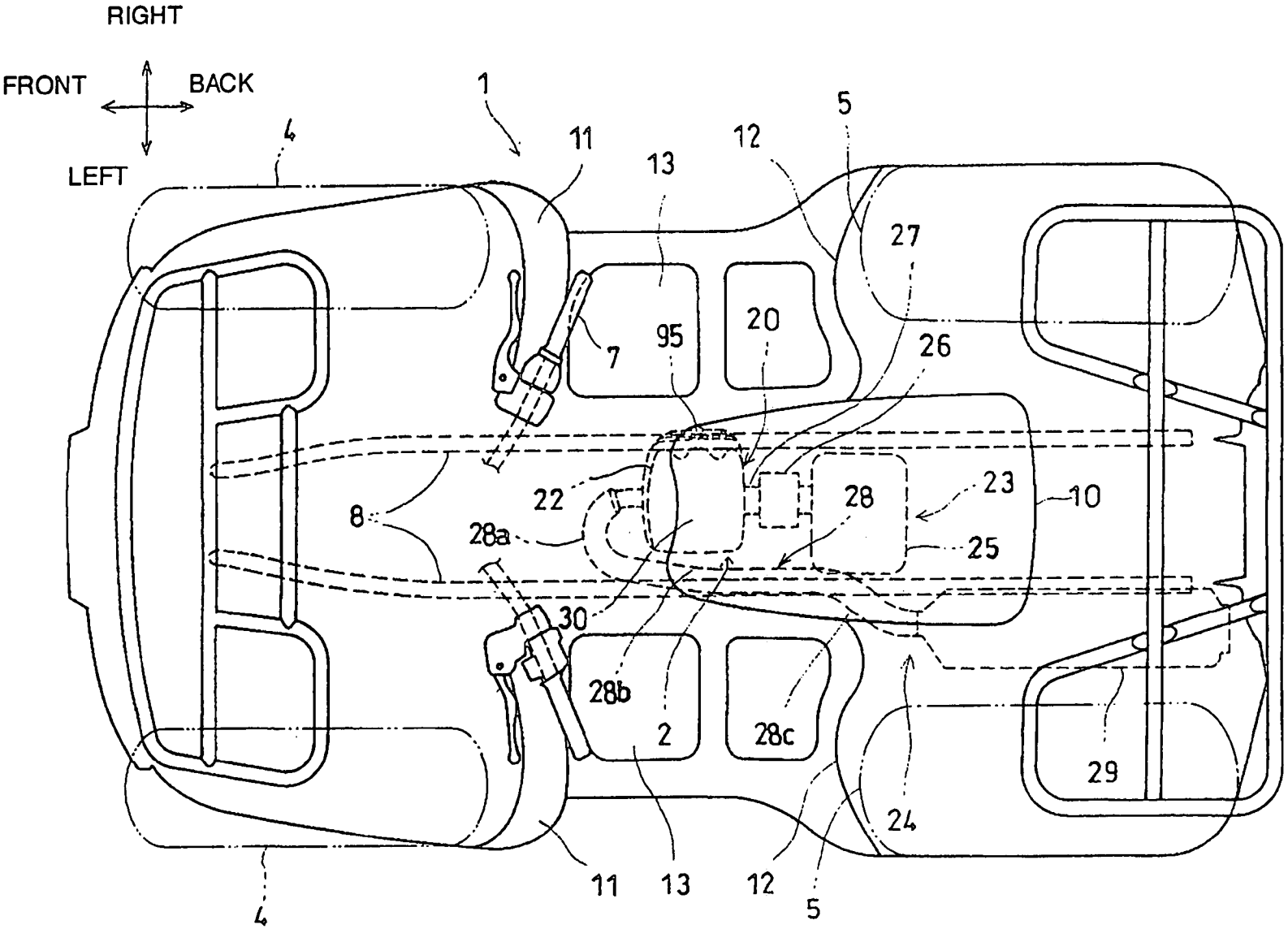
FIG. 2 is a schematic plan view showing the vehicle of FIG. 1.

Referring to FIGS. 1 and 2, an internal combustion engine 2 to which the present invention has been applied, is mounted on a saddle-ride type vehicle 1 capable of traveling on uneven land. In a body frame of the vehicle 1, in the front portion thereof, there are installed a pair of left and right front wheels 4, in the rear portion thereof, a pair of left and right rear wheels 5, and in the intermediate portion thereof, a power unit composed of an internal combustion engine 2 and a transmission 3 respectively. Both front wheels 4 are steered by a handlebar 7 installed to the upper end portion of the handlebar post 6 via an interlocking mechanism (not shown) to be provided on the lower end portion side of the handlebar post 6. Also, the vehicle 1 is a four-wheel-drive vehicle, and both front wheels 4 and both rear wheels 5 a re driven by a driving shaft drivingly connected to the output shaft of the transmission 3.

In this respect, in this specification and Claim, front and back, left and right coincide with the front and back, left and right of the vehicle 1.

The body frame has a pair of left and right main frames 8 for extending in a back-and-forth direction close to the center in the left and right directions; above both main frames 8, there are arranged a fuel tank 9 and a seat 10 to be located in the rear of the fuel tank 9; and below the main frames 8, there are arranged an internal combustion engine 2 and a transmission 3. Also, below the body frame on the left and right sides, a step 13, on which the driver puts his feet, is provided between a front fender 11 for covering the upper and rear portions of the front wheels 4 and a rear fender 12 for covering the front and upper portions of the rear wheel 5.

The internal combustion engine 2 is an air-cooled single-cylinder four-stroke internal combustion engine, and has an engine body 20 having a cylinder block 21 and a cylinder head 22; an intake air device 23 for conducting intake air into combustion space C (See FIG. 4) to be described later, formed in the engine body 20; and an exhaust device 24 for conducting combustion gas generated in the combustion space C as exhaust gas to the outside of the internal combustion engine 2.

Figure 3:
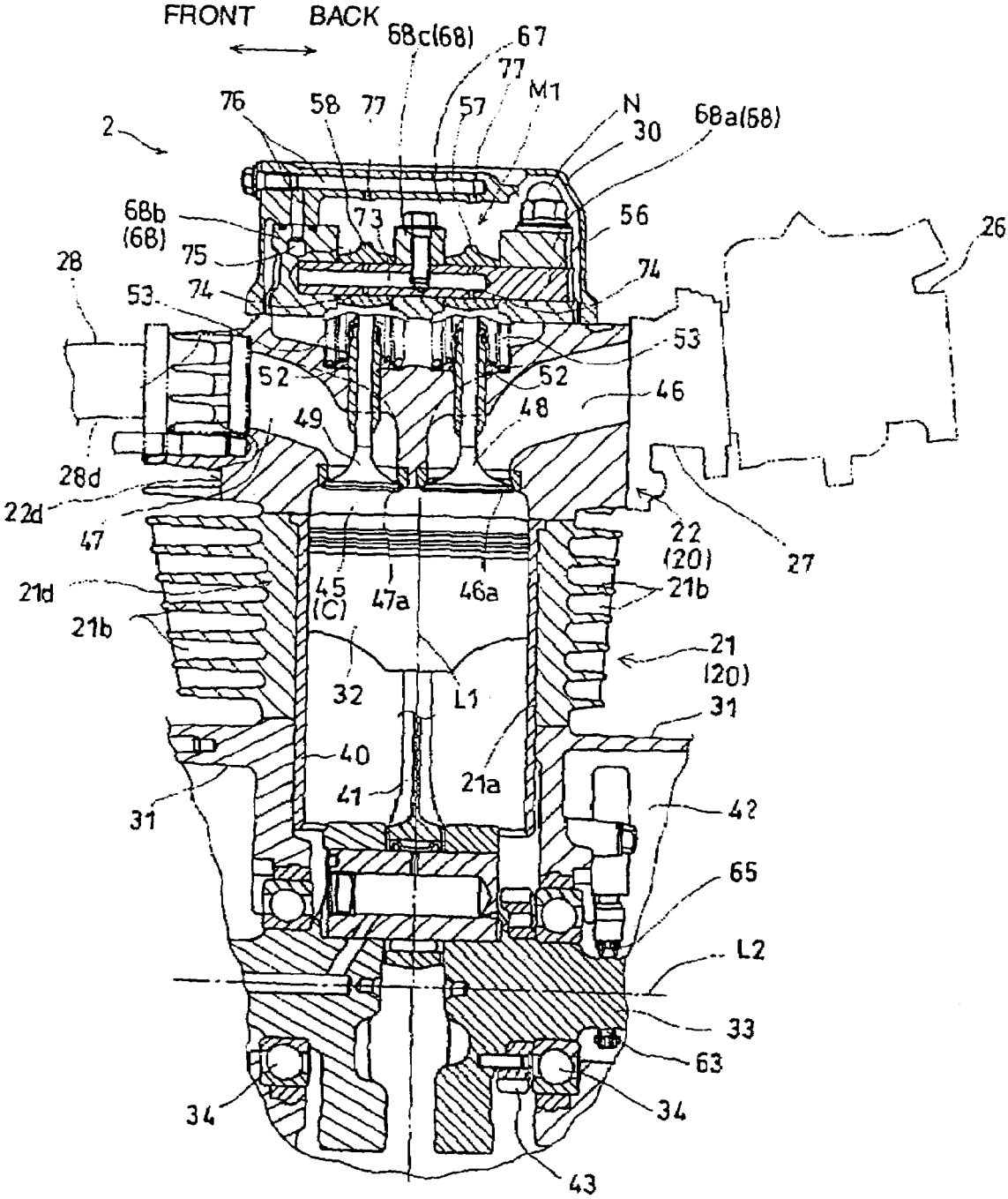
FIG. 3 is a cross-sectional view showing a principal part of the internal combustion engine of FIG. 1, a cross-sectional view substantially taken on line III—III of FIG. 5.

The intake air device 23 to be arranged in the rear of the engine body 20 has an air cleaner 25 for cleaning air taken in from the outside; a throttle body 26 to which there has been installed a fuel injection valve as fuel supply equipment connected to the air cleaner 25 for supplying fuel to intake air after cleaned; and an intake pipe 27 connected to the throttle body 26 at an upstream end portion, and connected to the cylinder head 22 at a downstream end portion, for serving dually as an insulator for conducting air-fuel mixture of intake air from the throttle body 26 and fuel from the fuel injection valve into the intake port 46 (See FIG. 3). The intake pipe 27, the throttle body 26 and the air cleaner 25 are arranged backward from the cylinder head 22 in this order successively.

The exhaust device 24 has an exhaust pipe 28 connected to the cylinder head 22 for conducting exhaust gas which has passed through an exhaust port 47 (See FIG. 3), and a muffler 29 to be connected to the exhaust pipe 28. The exhaust pipe 28 has a curvature 28*a* which extends forward from the cylinder head 22, thereafter curves in a U-character shape, and reverses backward for extending; a parallel portion 28*b* for extending backward in a row with the curvature 28*a*; and a rear portion 28*c* as a downstream portion for extending backward in a row with the parallel portion 28*b* to be connected to the muffler 29. The parallel portion 28*b* is a portion which is arranged in parallel with the engine body 20 in the longitudinal direction of the exhaust pipe 28 in a portion which becomes the parallel portion 28*b*, and is close to the engine body 20 and extends substantially along the engine body 20. The rear portion 28*c* is a portion which extends so as to gradually separate from the engine body 20.

Figure 4:
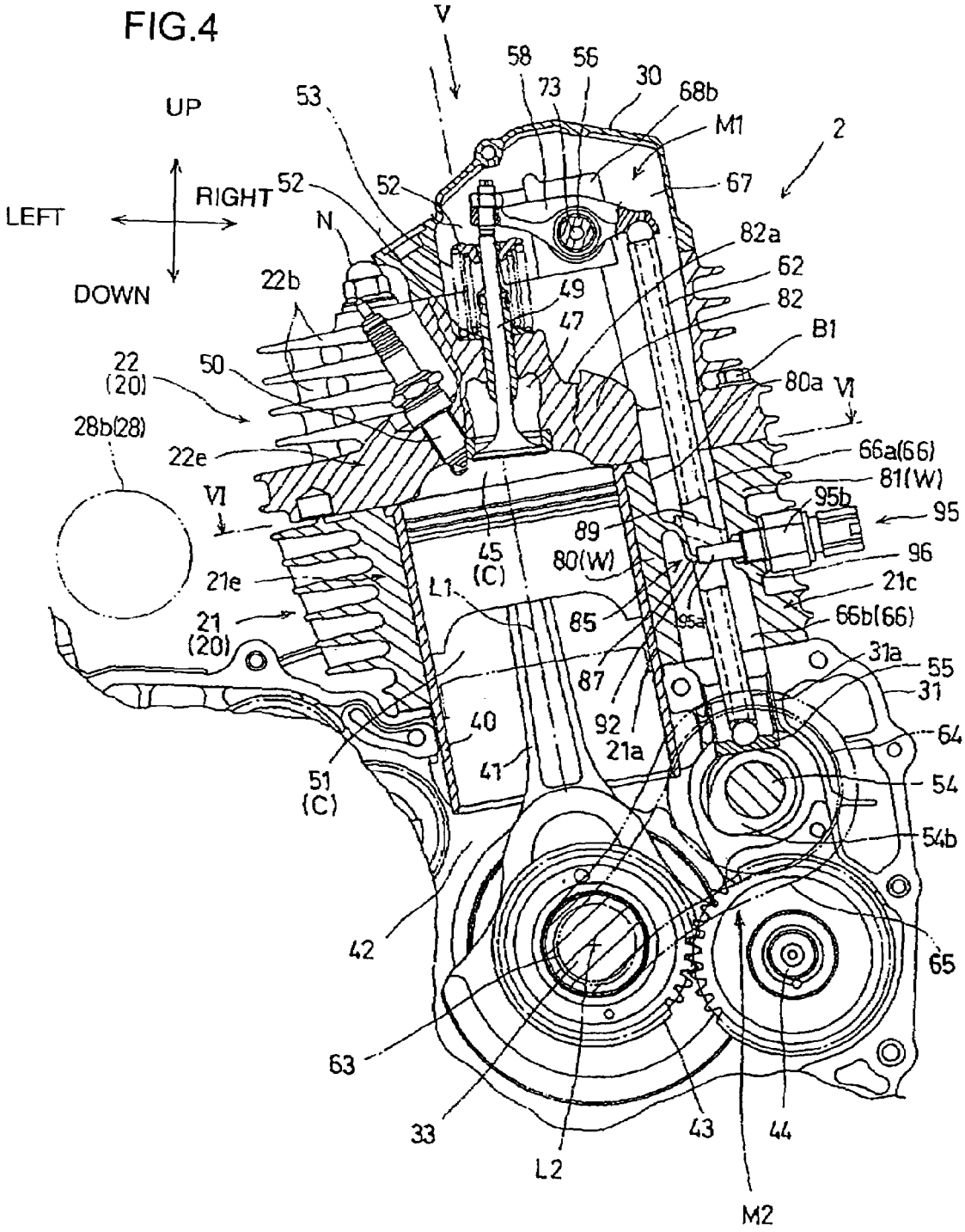
FIG. 4 is a cross-sectional view showing a principal part of the internal combustion engine of FIG. 1, a cross-sectional view substantially taken on line IV—IV of FIG. 5.

Referring to FIGS. 3 and 4, the engine body 20 has: a cylinder block 21 formed with a cylinder hole 21*a* in which a piston 32 is housed so as to be able to reciprocate in a direction of a cylinder axis L1 (hereinafter, referred to as cylinder axis direction), and a multiplicity of cooling fins 21*b*; a cylinder head 22 to be coupled to the upper end portion of the cylinder block 21, formed with a multiplicity of cooling fins 22*b*; a head cover 30 to be coupled to the upper end portion of the cylinder head 22; and a crankcase 31 to be coupled to the lower end portion of the cylinder block 21, for rotatively supporting the crankshaft 33 via a pair of main bearings 34. The crankcase 31 serves dually as a transmission case for housing a transmission 3 consisting of a full time meshing type gear transmission. Thus, the internal combustion engine 2 is mounted on the vehicle 1 in a state in which the cylinder axis L1 and the cylinder block 21 are inclined as it goes from the crankshaft 33 toward the cylinder head 22, in an inclined state to the left, in this case, and yet in a longitudinally-mounted layout in which a center line L2 of rotation of the crankshaft 33 orients toward the back-and-forth direction.

The cylinder block 21 and the cylinder head 22 are fastened to the crankcase 31 by means of a plurality of head bolts. These head bolts are comprised of: four stud bolts (not shown) planted in the crankcase 31 so as to be arranged at substantially regular intervals in the circumferential direction around the cylinder hole 21*a*; and two bolts B1 (See FIG. 5). A nut N is threadedly engaged with the tip portion of each of the stud bolts after it is inserted through a through-hole 35 (See FIG. 6) of the cylinder block 21 and a through-hole 36 (See FIG. 5) of the cylinder head 22. Some of the stud bolts are also inserted through through-holes 37 (See FIG. 5) of rocker shaft holders to be described later. Also, two bolts B1 are screwed into the crankcase 31 after inserted through a through-hole 38 (See FIG. 6) in the cylinder block 21 and a through-hole (See FIG. 5) in the cylinder head 22 outward a rod chamber 66 to be described later in a director of diameter. In this embodiment, the direction of diameter means a direction of radiation with the cylinder axis L1 as the center, and the circumferential direction means a circumferential direction with the cylinder axis L1 as the center.

A piston 32 slidably fitted in a cylinder liner 40 arranged within the cylinder hole 21*a* in a state integrally coupled to the cylinder block 21 is coupled to the crankshaft 33 housed in a crank chamber 42 to be formed by the crankcase 31 via a connecting rod 41. Also, in the crank chamber 42, there is housed a balancer shaft 44 to be rotationally driven at the same speed as the crankshaft 33 by a driving gear 43 coupled to the crankshaft 33.

The cylinder head 22 is formed with: a combustion chamber 45 consisting of a concave portion at a position opposite to the cylinder hole 21*a* in the direction of cylinder axis; an intake port 46 having an intake vent 46*a* opened in the combustion chamber 45; and an exhaust port 47 having an exhaust vent 47*a* opened in the combustion chamber 45, and is further provided with: an intake valve 48 for opening/closing the intake vent 46*a*; an exhaust valve 49 for opening/closing the exhaust vent 47*a*; and a spark plug 50 facing the combustion chamber 45.

The combustion chamber 45 constitutes combustion space C in which fuel supplied from the fuel injection valve 26 is ignited by the spark plug 50 for combustion together with a cylinder chamber 51 (in FIG. 4, a portion of the piston 32 located at a bottom dead center position is indicated by a two-dot chain line), which is variable capacity space to be formed on the cylinder head 22 side with respect to the piston 32 in the cylinder hole 21*a*. The piston 32 which is driven by pressure of combustion gas within the combustion space C for reciprocating rotationally drives the crankshaft 33 via the connecting rod 41.

Figure 5:
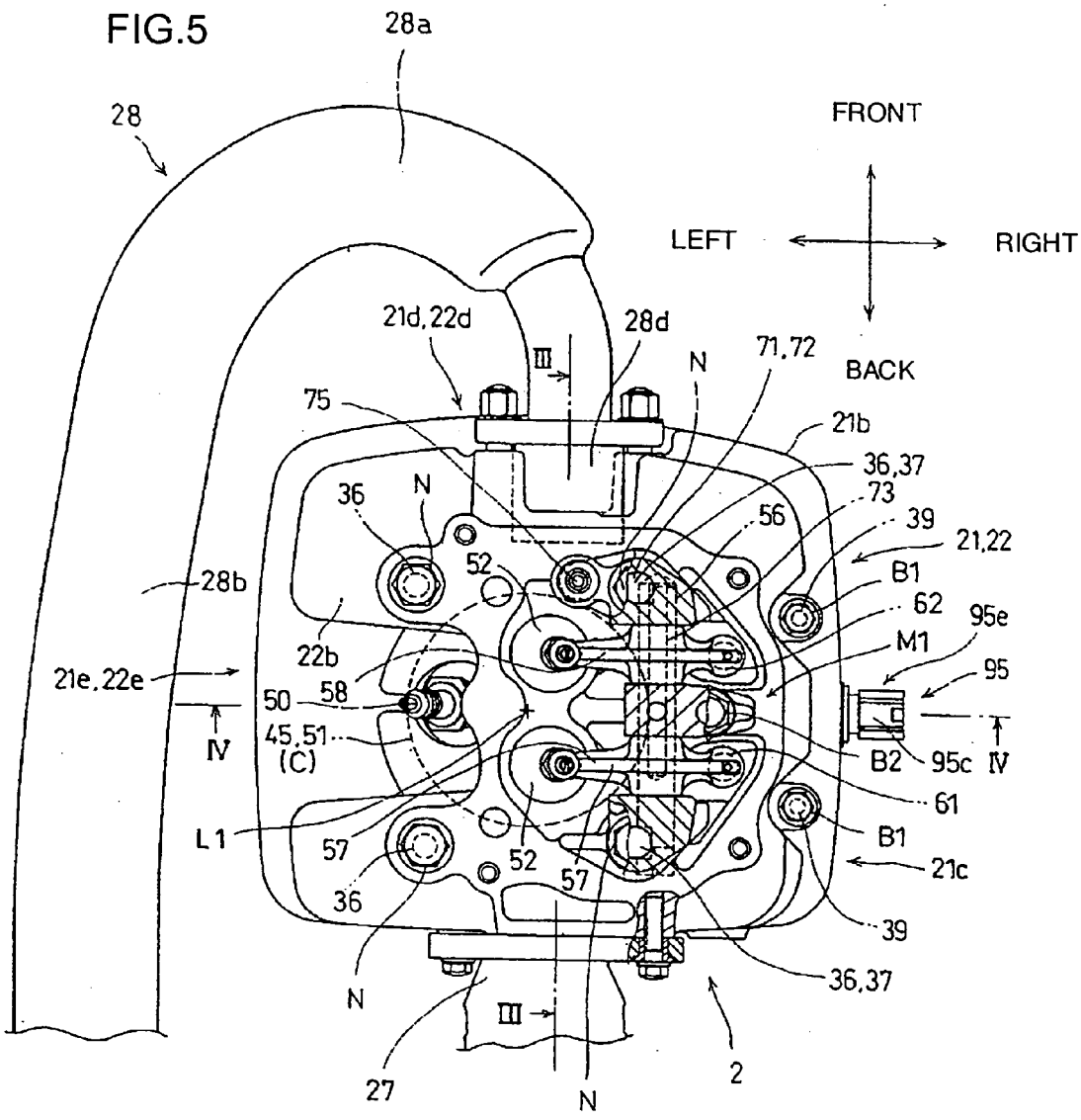
FIG. 5 is a view taken along the arrow V of FIG. 4 when the head cover is removed.

Referring to FIG. 5 together, a valve train M1 opens and closes an intake valve 48 and an exhaust valve 49 which are biased in a valve-closing direction by a valve spring 53 held between a pair of spring seats 52 in synchronization with rotation of the crankshaft 33. The valve train M1 has, as its component elements, an intake cam (not shown) and an exhaust cam 54*b* as a valve train cam; a camshaft 54 to be rotationally driven by power of the crankshaft 33 to be transmitted via a transmission mechanism M2; two tappets 55 (in FIG. 4, a tappet on the exhaust side is shown) as a pair of cam followers to be driven by the intake cam and the exhaust cam 54*b* respectively; an intake rocker arm 57 for abutting on the tip of the valve stem of the intake valve 48 and an exhaust rocker arm 58 for abutting on the tip of the valve stem of the exhaust valve 49, which are rockably supported on a rocker shaft 56 held by the cylinder head 22 respectively; and an intake rod 61 and an exhaust rod 62 (See also FIG. 6) which consist of a push rod as a driving force transmission member for abutting on both tappets 55, the intake rocker arm 57 and the exhaust rocker arm 58 at both ends respectively to transmit the motion of each tappet 55 to the intake rocker arm 57 and the exhaust rocker arm 58 respectively. Therefore, the valve train M1 is an OHV type valve train having the intake rod 61 and the exhaust rod 62 for transmitting a valve-opening driving force of the intake cam and the exhaust cam 54*b* to the intake valve 48 and the exhaust valve 49 which have been provided on the cylinder head 22.

The camshaft 54 having a center line of rotation parallel with the center line of rotation L2 of the crankshaft 33 is rotatively supported by the crankcase 31 and is housed within the crank chamber 42. The transmission mechanism M2 (See FIG. 4) has, as its component elements, a driving sprocket 63 provided on the crankshaft 33; a cam sprocket 64 provided on the camshaft 54; and an endless timing chain 65 as a driving force transmission member, spanned between both sprockets 63 and 64, and this transmission mechanism M2 causes the camshaft 54 to rotate at a half of the revolution speed of the crankshaft 33. In this case, the valve train M1 and the transmission mechanism M2 constitute a valve system M which is a system for opening/closing the intake valve 48 and the exhaust valve 49 in synchronization with the crankshaft 33.

Figure 6:
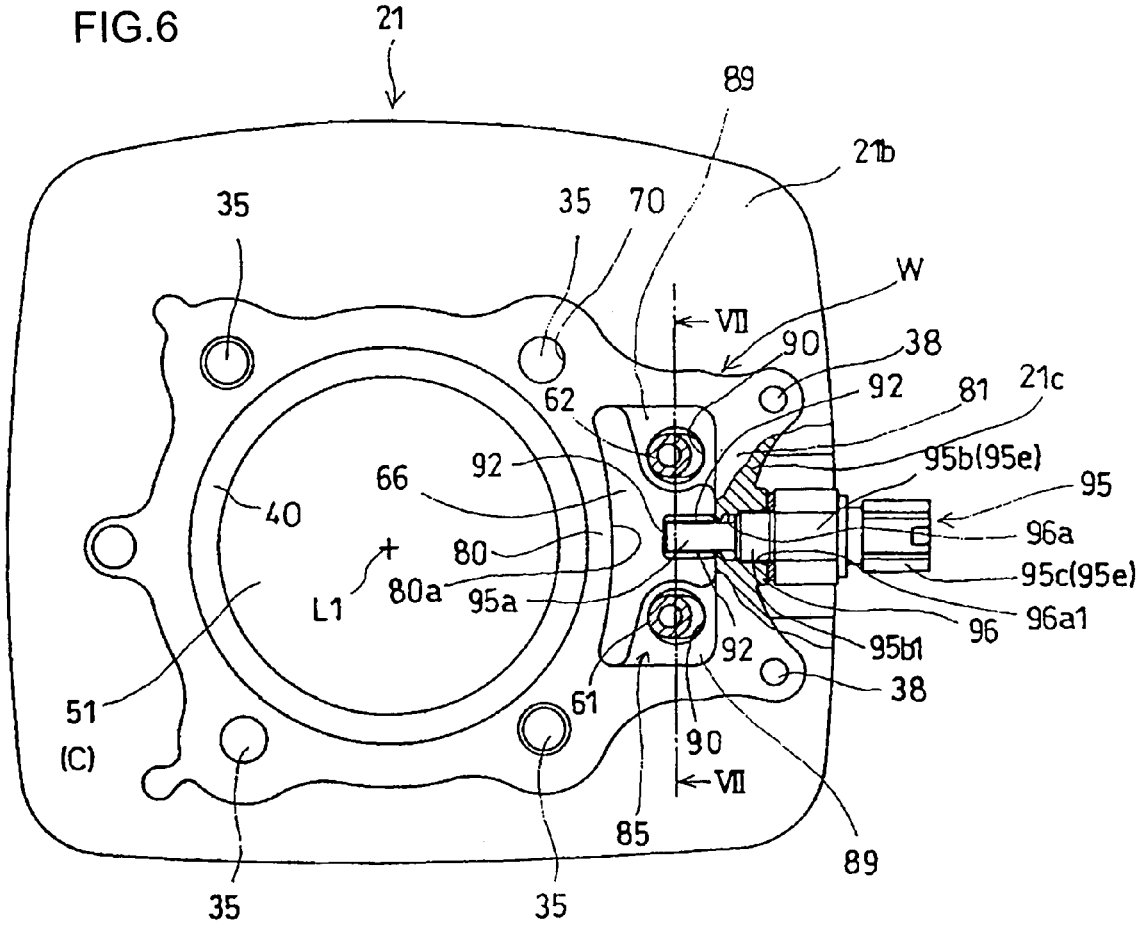
FIG. 6 is a view taken along the arrow VI of FIG. 4 showing a cylinder block.

Referring to FIGS. 4 and 6, the intake rod 61 and the exhaust rod 62 are housed in a rod chamber 66, which is a housing chamber consisting of a cavity formed adjacent to the cylinder chamber 51 along the cylinder axis direction in the cylinder block 21. Both rods 61, 62 are arranged between both tappets 55 slidably supported on a guide portion 31*a* provided on the crankcase 31 and intake and exhaust rocker arms 57, 58 respectively in a state that penetrates the rod chamber 66 opened in the crank chamber 42 and a main valve chamber 67 to be described later in the cylinder axis direction for reaching the crank chamber 42 and the main valve chamber 67.

Referring to FIGS. 3 to 5, each rocker arm 57, 58 is housed in the main valve chamber 67 to be formed by the cylinder head 22 and the head cover 30, and is rockably supported by the rocker shaft 56 which is held on the cylinder head 22 by a rocker shaft holder 68 coupled to the cylinder head 22. The intake rocker arm 57 abuts on the intake rod 61 at one end portion thereof, and abuts on the intake valve 48 at the other end portion thereof. Also, the exhaust rocker arm 58 abuts on the exhaust rod 62 at one end portion thereof, and abuts on the exhaust valve 49 at the other end portion thereof. Also, the rocker shaft holder 68 is composed of: two end portion holders 68*a*, 68*b* for holding both end portions of the rocker shaft 56; and a central holder 68*c* located between both rocker arms 57, 58 for holding a central portion of the rocker shaft 56. Both end portion holders 68*a*, 68*b* are coupled to the cylinder head 22 with the stud bolt, and the central holder 68*c* is coupled to the cylinder head 22 with the bolt B2.

Therefore, in this embodiment, a valve chamber, which is a housing chamber for housing the valve train M1, is composed of: one portion of the crank chamber 42 in which the camshaft 54 is housed; a second valve chamber composed of the rod chamber 66; and a third valve chamber composed of the main valve chamber 67.

Referring to FIGS. 3, 5 and 6, lubricating oil is pumped up by an oil pump to be driven by the crankshaft 33 from an oil pan to be constructed by the lower portion of the crankcase 31 through an oil strainer, and reaches an oil path 71 formed in the cylinder head 22 from an oil path (not shown) formed in the crankcase 31 via an oil path 70 formed in the cylinder block 21. One portion of the lubricating oil in the oil path 71 is supplied to an oil path 73 provided at the rocker shaft 56 via the oil path 72 formed in the end portion holder 68*b*, is supplied to a sliding portion between each rocker arm 57, 58 and the rocker shaft 56 from a supply port 74 of the rocker shaft 56. The remaining portion is supplied to an oil path 76 provided in the head cover 30 via an oil path 75 which branches off from the oil path 72 and is formed at the end portion holder 68*b*, and is supplied to lubrication places such as the sliding portion of the valve train M1 within the main valve chamber 67 from a supply port 77 of the head cover 30, for example, abutted portions between rods 61, 62 in each rocker arm 57, 58 and the intake valve 48 and the exhaust valve 49, and lubrication places in the intake valve 48 and the exhaust valve 49. In this case, the oil paths 70, 71, 72 are formed by space to be formed between the stud bolt and the wall surfaces of the through-holes 35, 36, 37.

The lubricating oil after lubricating lubrication places of the valve train M1, the intake valve 48 and the exhaust valve 49 within the main valve chamber 67 flows into the rod chamber 66 from the main valve chamber 67, and further flows into the crank chamber 42 to return to the oil pan. Therefore, the rod chamber 66 serves dually as a return oil path of the lubricating oil which has lubricated the valve train M1 housed within the main valve chamber 67, and the return lubricating oil (hereinafter, referred to as "return lubricating oil" simply), which is the lubricating oil after lubricating lubrication places within the main valve chamber 67 such as each rocker arm 57, 58, the intake valve 48 and the exhaust valve 49 returns to the oil pan for constituting a lubricating oil storage portion of the internal combustion engine 2 via this return oil path. In this embodiment, the return oil path is the only oil path formed in the cylinder block 21 when the return lubricating oil returns from the main valve chamber 67 to the oil pan.

Figure 7:
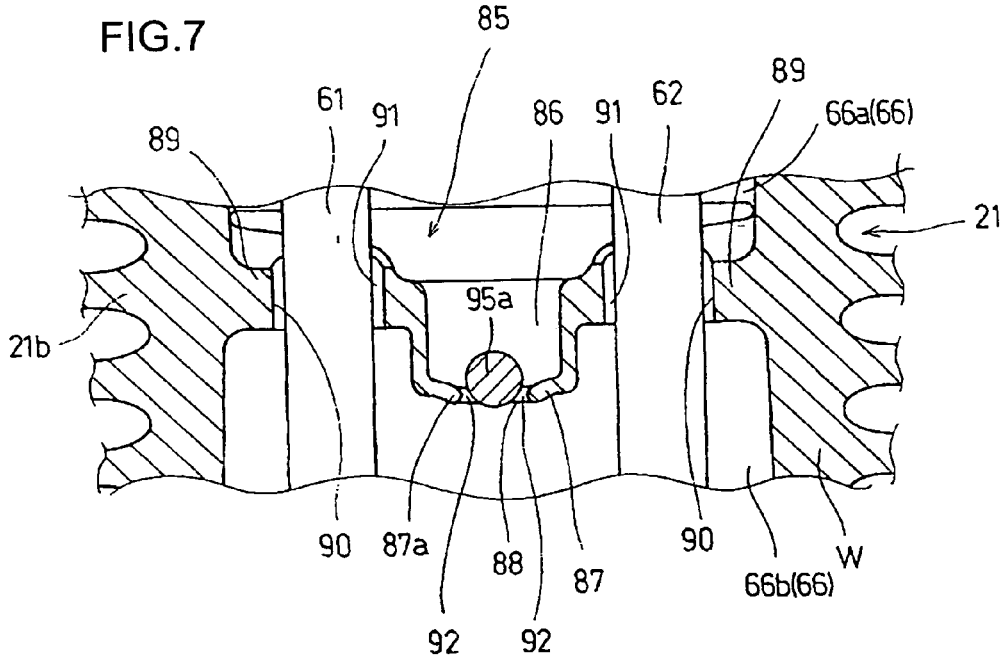
FIG. 7 is a cross-sectional view taken on line VII—VII of FIG. 6.

Referring to FIGS. 4, 6 and 7, the rod chamber 66 is located adjacent to the outside in a direction of diameter and to the right thereof with respect to the combustion chamber C. Since both rods 61, 62 are housed, the rod chamber 66, the width in the peripheral direction of which is remarkably large as compared with an oil path in which only the lubricating oil circulates, is formed by being enclosed with a chamber wall W having an inner peripheral wall 80 inward in a direction of diameter and an outside peripheral wall 81 outward the inner peripheral wall 80 in the direction of diameter. Further, within the rod chamber 66, there is provided an oil reservoir 85 for storing the return lubricating oil which flows down along the inner wall surface 80*a* of the inner peripheral wall 80 which is also the chamber wall of the cylinder chamber 51.

The inner peripheral wall 80 is constructed by a two-layer wall of one portion of the cylinder liner 40 and one portion of the cylinder block 21. On the one hand the inner peripheral wall 80 becomes a partition wall for partitioning into the cylinder chamber 51 and the rod chamber 66, the inner peripheral wall 80 is constructed by one portion of the cylinder head 22 at a upper end portion which is an end portion on the cylinder head 22 side and is combined with a combustion chamber wall 82 for forming the combustion chamber 45. Thus, since an inner wall surface 80*a* of the inner peripheral wall 80 is an upward surface, the greater part of the return lubricating oil flows down along the inner wall surface 80*a* within the rod chamber 66 after flowing along the outer wall surface 82*a* of the combustion chamber wall 82, and flows into the crank chamber 42 to return to the oil pan.

An oil reservoir 85 having an oil chamber 86 consisting of a concave portion in which the return lubricating oil for flowing down along the inner wall surface 80*a* is stored is integrally formed with the chamber wall W including the inner peripheral wall 80 and the outer peripheral wall 81; is constructed by a partition wall for partitioning the rod chamber 66 into an upper chamber 66*a* on the cylinder head 22 side and a lower chamber 66*b* on the crankcase 31 side; and is located at a position slightly closer to the cylinder head 22 than the center of a stroke range of the piston 32, or in the neighborhood of the center of the stroke range. At the bottom wall 87 of the oil chamber 86 which is also the bottom wall of the oil reservoir 85, there is formed a slit 88 as an aperture through which the lubricating oil stored in the oil chamber 86 is caused to flow out always into the lower chamber. In this slit 88, there is inserted a sensor 95*a* of an oil temperature sensor 95 installed to the outer peripheral wall 81 in order to detect temperature of the return lubricating oil within the rod chamber 66.

The oil reservoir 85 has a pair of upper walls 89 which inclines downward from the inner peripheral wall 80 toward the outer peripheral wall 81 with the oil chamber 86 sandwiched therebetween, and on both upper walls 89, there are formed through-holes 90 through which the intake rod 61 and the exhaust rod 62 are inserted respectively. Within each through-hole 90, between each rod 61, 62 and the wall surface of the through-hole 90, there are formed clearances. Thus, through a pair of outflow passages 91 to be constituted by the clearances, a portion of lubricating oil which overflows from the oil chamber 86 is supplied to sliding portions between each rod 61, 62 and each tappet 55 by going along each rod 61, 62 or dropping within the lower chamber 66*b*, and thereafter, returns to the oil pan via the crank chamber 42 together with the overflowed remaining lubricating oil.

The oil temperature sensor 95 is installed to an installation area 96 which has been formed on either side portion of the cylinder block 21 in the left and right directions, in this case, on the right side portion 21*c*, which is a side portion on the right side. The installation area 96 is, in this embodiment, formed on the chamber wall W of the rod chamber 66, more specifically, on the outer peripheral wall 81. The installation area 96 is formed with an installation hole 96*a* consisting of a through-hole which penetrates the outer peripheral wall 81 in a direction of diameter and is opened on the oil chamber 86. The oil temperature sensor 95 is inserted into the installation hole 96*a* for installation such that the sensor 96*a* is located within the oil chamber 86, or in this embodiment, is partially located within the slit 88. The slit 88 and the installation hole 96*a* are, in this embodiment, formed by one process of machining from the outer surface of the outer peripheral wall 81, and thereafter, on the installation hole 96*a*, there is performed machining for forming a threaded portion 96*a*1 such that the oil temperature sensor 95 is screwed in.

The oil temperature sensor 95 has: a sensor 95*a* for sensing temperature of lubricating oil; a body portion 95*b* in which there is formed a screw portion 95*b*1 for threadedly engaging with a threaded portion 96*a*1 of an installation hole 96*a* formed on the outer peripheral wall 81 and which holds the sensor 95*a*; and a coupler portion 95*c* to be connected to the body portion 95*b*, to which a coupler having a terminal connected to an electric wire for transmitting a detection signal to an electronic control unit is connected. Thus, temperature obtained by detecting with the oil temperature sensor 95 is inputted into the electronic control unit, and is used in order to control an amount of fuel to be injected from the fuel injection valve, ignition timing of the spark plug 50 and the like, and for a malfunctioning warning system of the internal combustion engine 2 such as overheat.

In a state in which the oil temperature sensor 95 has been installed to the cylinder block 21, one portion of the body portion 95*b*, which is one portion of the oil temperature sensor 95, and the coupler portion 95*c* are exposed to the outside of the cylinder block 21, and this is an exposure portion 95*e* of the oil temperature sensor 95. Also, in an installation state of the oil temperature sensor 95, the sensor 95*a* passes through the outer peripheral wall 81 and is located within the rod chamber 66, and is located within the oil chamber 86 in such a state as to partially shut the slit 88. Between the sensor 95*a* and an edge portion 87*a* of the bottom wall 87 for regulating the slit 88, there is formed a clearance, and after such a degree of amount of oil that permits the sensor 95*a* to be soaked in the lubricating oil is secured within the oil chamber 86, there is constructed a drain passage 92 for flowing out always the lubricating oil stored in the oil chamber 86 by means of this clearance. For this reason, the lubricating oil flows along the chamber walls (inner peripheral wall 80) of the combustion chamber wall 82 and the cylinder chamber 51, whereby while cooling those chamber walls, new return lubricating oil with temperature of those chamber walls reflected flows in the oil reservoir 85, old return lubricating oil which flowed in before flows out of the oil reservoir 85 via the drain passage 92, and within the oil chamber 86, no lubricating oil stagnates, but new return lubricating oil exists around the sensor 95*a*.

Next, with reference to FIGS. 1 to 5, the description will be made of layout of the exhaust pipe 28 and the oil temperature sensor 95. In the cylinder block 21, the exhaust pipe 28 is arranged facing another side portion different from the right side portion 21*c* to which the oil temperature sensor 95 is installed. Specifically, a curvature 28*a* of the exhaust pipe 28 is arranged facing each front side portion 21*d*, 22*d* of the cylinder block 21 and the cylinder head 22, and yet after extending forward from the cylinder head 22, curves in a U-character shape in a direction that separates from the exposure portion 95*e* on the opposite side to the right side portion 21*c*. Also, the parallel portion 28*b* is arranged facing the side portion of either of the other side portions of the cylinder block 21 and the cylinder head 22 in the left and right directions at a position facing the oil temperature sensor 95 with the cylinder chamber 51 sandwiched therebetween, in this case, facing the left side portions 21*e*, 22*e*.

Therefore, during traveling of the vehicle 1, on the exposure portion 95*e* of the oil temperature sensor 95 and the parallel portion 28*b* of the exhaust pipe 28 which are divided between the right side portion 21*c* and the left side portion 21*e* of the cylinder block 21 and arranged, a running wind easily strikes.

The exposure portion 95*e* is in a position which is not directly exposed to radiant heat because the radiant heat from the exhaust pipe 28 including the rear portion 28*c*, to say nothing of from the curvature 28*a* and the parallel portion 28*b* is shielded by the cylinder block 21 having cooling fins 21*b* and the cylinder head 22 having cooling fins 22*b*. Accordingly, when with respect to an imaginary plane including the cylinder axis L1, a direction perpendicular to the imaginary plane is viewed from the oil temperature sensor 95, at least the exhaust pipe 28 from the connected portion 28*d* (See FIGS. 3, 5) with the cylinder head 22 to the parallel portion 28*b* via the curvature 28*a* is located in a hidden state behind the cylinder block 21 or the cylinder head 22.

Next, the description will be made of an operation and an effect of the embodiment structured as described above.

When the internal combustion engine 2 is driven, lubricating oil in the oil pan is pumped up by the oil pump, and is supplied to lubrication places of the intake valve 48 and the exhaust valve 49 within the main valve chamber 67 and each rocker arm 57, 58, which is one portion of the valve train M1, from each supply port 74, 77 of the rocker shaft 56 and the head cover 30 via the oil paths 70 to 73, 75, 76 for constituting a supply oil path. The lubricating oil after lubricating those lubrication places flows along the outer wall surface 82*a* of the combustion chamber wall 82 as return lubricating oil to cool the combustion chamber wall 82, then flows down along the inner wall surface 80*a* of the inner peripheral wall 80, which is the chamber wall W of the rod chamber 66, to cool the chamber wall (inner peripheral wall 80) of the cylinder chamber 51. Thereafter, the lubricating oil flows into the oil reservoir 85, one portion of which is stored in the oil chamber 86. The lubricating oil which passes through an outflow passage 91 and flows out from the oil reservoir 85 lubricates lubrication places such as the sliding portion between each rod 61, 62 and each tappet 55 and the sliding portions between the intake cam and the exhaust cam 54*b*, and each tappet 55 through the lower chamber 66*b*, and flows out from the oil reservoir 85 via a drain passage 92 to flow into the crank chamber 42 for returning to the oil pan in the same manner as the lubricating oil which has passed through the lower chamber 66*b*.

In the cylinder block 21 formed with the cylinder chamber 51, both rods 61, 62 of the valve train M1 are housed, a rod chamber 66 serving dually as a return oil path of the return lubricating oil is formed, and an oil temperature sensor 95 is installed to the cylinder block 21 in order to detect temperature of the lubricating oil within the rod chamber 66. Thereby, since the oil temperature sensor 95 detects temperature of the lubricating oil within the rod chamber 66 serving dually as the return oil path, it becomes possible to detect engine temperature in a stable state and yet with high precision because the temperature fluctuation is not exceedingly large. Further, since there is no need to provide the cylinder block 21 with a return oil path capable of temperature measurement by an oil temperature sensor separately from the rod chamber 66, it is possible to restrain the cylinder block 21 from becoming large-sized as compared with the cylinder block 21 which is separately provided with a return oil path for detecting temperature of lubricating oil, and a rod chamber for housing, for example, a push rod, which is a component element of the valve train. Also, since there is no need to install the oil temperature sensor 95 by avoiding the rod chamber 66, whereby layout of the oil temperature sensor 95 is not restricted by the rod chamber 66, the degree of freedom of the oil temperature sensor 95 in layout becomes larger.

Also, since the oil temperature sensor 95 detects temperature of the lubricating oil which has flowed down along the outer wall surface 82*a* of the combustion chamber wall 82 and the inner wall surface 80*a* of the inner peripheral wall 80, which is also a chamber wall of the cylinder chamber 51, temperature obtained by reflecting the temperature of the cylinder head 22 and the cylinder block 21 more accurately can be detected as the engine temperature.

The inner peripheral wall 80 is provided with the oil reservoir 85 for storing the lubricating oil which flows along its inner wall surface 80*a*; the bottom wall 87 of the oil reservoir 85 is formed with the drain passage 92 for causing one portion of the lubricating oil stored to flow out from the oil reservoir 85 at all times; and the oil temperature sensor 95 detects temperature of the lubricating oil stored in the oil reservoir 85, whereby the engine temperature can be detected with further higher precision. Also, since the lubricating oil within the oil reservoir 85 flows out from the drain passage 92 at the bottom wall 87 at all times, old lubricating oil does not stagnate, but is smoothly replaced with newly flowed-in lubricating oil in the oil reservoir 85. Since the temperature of the lubricating oil obtained by reflecting the engine temperature closer to the newest engine driving state is detected by the oil temperature sensor 95, the detection precision of the engine temperature through the temperature of the lubricating oil is improved.

For this reason, when controlling an air-fuel ratio, for example, in a first idle state, since an amount of fuel from the fuel injection valve can be controlled with high precision in accordance with the engine temperature detected by the oil temperature sensor 95, the warm-up of the internal combustion engine 2 and the exhaust emission performance can be improved. Similarly, on the basis of a detection signal from the oil temperature sensor 95, the ignition timing can be controlled with high precision in accordance with the engine temperature, and temperature condition of the internal combustion engine 2 such as overheat can be grasped accurately.

The oil reservoir 85 is provided with the outflow passage 91 for supplying the lubricating oil which overflows from the oil reservoir 85 to the intake rod 61 and the exhaust rod 62, whereby the lubricating oil which overflows from the oil reservoir 85 is used to lubricate both rods 61, 62. Therefore, since both rods 61, 62 can be lubricated by taking advantage of the oil reservoir 85 for detecting temperature of lubricating oil without providing any lubricating mechanism separately, lubricity of the both rods 61, 62 to be housed within the rod chamber 66 can be improved or maintained. Also, since the rod chamber 66 serves dually as a return path of the lubricating oil, the engine body 20 can be restrained from becoming large even in this respect.

Further, the outflow passage 91 is provided in the oil reservoir 85 and each rod 61, 62 is constructed by a through-hole 90 through which it is inserted, whereby it is not necessary to form any outflow passage of lubricating oil which overflows from the oil chamber 86 separately from the through-hole 90. Therefore, it is possible to enlarge the capacity of the oil chamber 86, and to contribute to improvement of detection precision of temperature of the lubricating oil even in this point.

In a state in which the oil temperature sensor 95 has been installed to the cylinder block 21, the sensor 95*a* is located within the oil chamber 86 in a state in which the slit 88 is partially shut, and the drain passage 92 is constructed by a clearance to be formed between the sensor 95*a* and an edge portion 87*a* of the bottom wall 87 for regulating the slit 88. Therefore, by changing the shape and size of the sensor 95*a*, the flow rate of the lubricating oil for flowing out from the drain passage 92 can be adjusted. Also, since the slit 88 is formed by one machining process together with the installation hole 96*a*, the structure is simplified, moreover with a small number of machining man-hours, the oil reservoir 85 having the drain passage 92 and the installation area 96 of the oil temperature sensor 95 can be formed at low cost.

The oil temperature sensor 95 is installed to the outer peripheral wall 81 of the rod chamber 66 having remarkably large width in the circumferential direction as compared with the oil passage in which only the lubricating oil is circulated, whereby the degree of freedom of the oil temperature sensor 95 in layout becomes large. Therefore, interference with peripheral parts to be arranged in the vicinity of the engine body 20 can be easily avoided.

The curvature 28*a* of the exhaust pipe 28 and the parallel portion 28*b* are arranged respectively facing the front-side portions 21*d*, 22*d* and the left-side portions 21*e*, 22*e* of the cylinder block 21 and the cylinder head 22, which are different from the right-side portion of the cylinder block 21 in which the exposure portion 95*e* of the oil temperature sensor 95 is arranged; and the exposure portion 95*e* is located in a position where radiant heat from the exhaust pipe 28 is shielded by the cylinder block 21 and the cylinder head 22, whereby there is no possibility that radiant heat from the exhaust pipe 28 directly strikes on the exposure portion 95*e* of the oil temperature sensor 95 installed to the cylinder block 21 by the engine body 20. Radiant heat from the curvature 28*a* and the parallel portion 28*b*, which is a portion of the exhaust pipe 28 to be arranged comparatively close to the oil temperature sensor 95 particularly, is also shielded by the engine body 20 itself without providing the engine body 20 with ribs and the bracket, and yet without the need for arranging the exhaust pipe 28 far apart from the exposure portion 95*e* because the portion which those face is arranged facing the front-side portions 21*d*, 22*d* and the left-side portions 21*e*, 22*e*, which are the other side portions of the engine body 20 different from the right-side portion 21*c* in which the exposure portion 95*e* is arranged. As a result, the influence of thermal radiation from the exhaust pipe 28 is reduced, temperature of the lubricating oil is accurately detected by the oil temperature sensor 95, and the detection precision of the engine temperature based on the temperature of lubricating oil is improved. Moreover, it is possible to reduce the cost of the internal combustion engine 2 and to restrain it from becoming large-sized, and yet, layout of the oil temperature sensor 95 to be installed to the cylinder block 21 is not restricted by the ribs and bracket for shielding the thermal radiation, but the degree of freedom in layout becomes large.

The internal combustion engine 2 is mounted on the vehicle 1; the exhaust pipe 28 has the parallel portion 28*b* to be arranged in parallel with the engine body 20 in the longitudinal direction; the exposure portion 95*e* of the oil temperature sensor 95 is arranged in the right-side portion 21*c* of the cylinder block 21; and the parallel portion 28*b* is arranged facing the left-side portions 21*e*, 22*e* of the engine body 20, whereby the oil temperature sensor 95 and the parallel portion 28*b* are divided into both side portions in the left and right directions in the engine body 20 with the combustion space C sandwiched therebetween. Therefore, during traveling of the vehicle 1, a running wind easily strikes on the oil temperature sensor 95 and the parallel portion 28*b*, and the running wind cools the oil temperature sensor 95, and hot air around the parallel portion 28*b* is carried away. Therefore, the influence of thermal radiation is reduced and temperature of the lubricating oil due to the oil temperature sensor 95 is accurately detected.

Also, since the oil temperature sensor 95 and the parallel portion 28*b* are arranged on the right-side portion 21*c* and the left-side portions 21*e*, 22*e*, respectively which are side portions, opposite to each other, of the cylinder block 21, after having accurately detected temperature of the lubricating oil by the oil temperature sensor 95 with the influence of the thermal radiation reduced, it is possible to arrange the parallel portion 28*b* compactly by arranging it in proximity to the cylinder block 21.

The exhaust pipe 28 has a curvature 28*a* which after extending from the cylinder head 22, curves in a direction that separates from the exposure portion 95*e* on the opposite side to the right-side portion 21*c*, whereby the curvature 28*a* curves in a direction that recedes from the oil temperature sensor 95. Therefore, since the oil temperature sensor 95 becomes difficult to be affected by the radiant heat from the curvature 28*a*, it is possible to make the degree of freedom of the oil temperature sensor 95 in layout further large.

Concerning an embodiment obtained by partially changing the structure of the above-described embodiment, the description will be made of the structure changed hereinafter.

The valve train M1 may be applied to an OHC type internal combustion engine in which the camshaft is provided in the cylinder head and is housed within the main valve chamber to be formed on the cylinder head. In this case, a chain chamber in which timing chain, which is a component element of the transmission mechanism M2, is housed corresponds to the housing chamber in which the component element of the valve system M is housed, and the timing chain corresponds to the driving force transmission member.

Also, a housing chamber in which component elements of the valve system M are housed may not be formed by only the cylinder block, but be formed by the cylinder block and a cover to be attached to the cylinder block. The internal combustion engine may be of multi-cylinder, and in that case, the exhaust pipe may be equipped with a manifold. Also, the internal combustion engine may be of the water-cooled type.

Although the sensor 95*a* of the oil temperature sensor 95 has been arranged within the oil chamber 86 in a state to be inserted into the slit 88, it may be inserted within the oil chamber 86 irrespective of the slit. In this case, since the drain passage 92 can be constructed by only the aperture of the slit, one having a smaller aperture area than the slit 88 is used, and the aperture to be formed at the bottom wall 87 may be a plurality of slits in place of a single slit, and further a single hole or a plurality of holes may be used except the slit.

The internal combustion engine 2 may be mounted on the vehicle 1 in a state in which it is inclined in any other directions than the left, and the oil temperature sensor 95 may be also installed onto any other side portion than the right-side portion 21*c* of the cylinder block 21. For example, when the internal combustion engine 2 is mounted on the vehicle 1 in a state inclined to the right, the oil temperature sensor 95 is installed to the left-side portion 21*e* of the cylinder block 21, and the parallel portion 28*b* is arranged facing the right-side portion of the engine body 20. Also, the oil temperature sensor 95 may be installed to the cylinder head 22, which is the upper-side portion of the engine body 20, and in this case, the curvature 28*a* curves downward, and the parallel portion 28*b* is arranged facing the lower-side portion of the engine body 20.

The intake rod and the exhaust rod may be constituted by a pull rod in place of the push rod. The fuel supply equipment has been the fuel injection valve in the embodiment, but it may be a carburetor.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An internal combustion engine comprising:

an engine body in which a combustion space and a valve system housing chamber have been formed longitudinally, wherein the valve system housing chamber forms a return path for return lubrication oil;

a valve system housed in said valve system housing chamber, the valve system including a valve train for opening and closing an intake valve and an exhaust valve; and a sensor for detecting an engine drive state, said sensor being connected to a side of said engine body such that an external portion of said sensor is disposed outside of said engine body and an internal portion of said sensor is in fluid communication with lubrication oil, wherein said valve system housing chamber includes a chamber wall having an oil reservoir for storing lubricating oil, and said sensor comprises an oil temperature sensor for detecting the temperature of the lubrication oil in said oil reservoir; and wherein the valve system further comprises driving force transmission members, and said oil reservoir is provided with an outflow passage for supplying the lubricating oil which overflows from said oil reservoir to said driving force transmission members.

2. The internal combustion engine according to claim 1, wherein said engine body further comprises a cylinder head provided with said intake valve and said exhaust valve;

said valve train comprises an intake rod and an exhaust rod for transmitting a valve-opening driving force of a valve train cam provided on the camshaft to said intake valve and said exhaust valve; and said oil reservoir is provided with through-holes through which said intake rod and said exhaust rod are inserted.

3. The internal combustion engine according to claim 2, wherein said outflow passage is constructed by said through-hole.

4. An internal combustion engine comprising:

an engine body which a combustion space and a valve system housing chamber have been formed longitudinally, wherein the valve system housing chamber forms a return path for return lubrication oil;

a valve system housed in said valve system housing chamber, the valve system including a valve train for opening and closing an intake valve and an exhaust valve; and a sensor for detecting an engine drive state, said sensor being connected to a side of said engine body such that an external portion of said sensor is disposed outside of said engine body and an internal portion of said sensor is in fluid communication with lubrication oil, wherein said valve system housing chamber includes a chamber wall having an oil reservoir for storing lubricating oil, said oil reservoir including an outflow passage for allowing a lubricating oil to flow out from said oil reservoir, and said sensor comprises an oil temperature sensor for detecting the temperature of the lubrication oil in said oil reservoir; and wherein the side of said engine body to which said sensor is connected is a first side and further comprising an exhaust pipe connected to a second side of said engine body for discharging exhaust gas from said combustion space, said exhaust pipe being positioned such that the engine body shields radiant heat from said exhaust pipe from the external portion of said sensor.

5. The internal combustion engine according to claim 4, wherein:

said engine body is mounted on a vehicle;

said exhaust pipe has a parallel portion arranged in parallel with said engine body in a longitudinal direction;

said first side portion is either a left or a right side portion of said engine body; and said parallel portion is arranged along a side portion of said engine body that is opposite said first side portion.

6. The internal combustion engine according to claim 4, wherein said exhaust pipe has a curvature, which after extending from said engine body, curves in a direction away from said sensor.

7. The internal combustion engine according to claim 4, wherein said sensor is an oil temperature sensor for detecting temperature of lubricating oil.

* * * * *